United States Patent [19]

Cappucci

[11] Patent Number: 5,063,365

[45] Date of Patent: Nov. 5, 1991

[54] MICROWAVE STRIPLINE CIRCUITRY

[75] Inventor: Joseph D. Cappucci, Wayne, N.J.

[73] Assignee: Merrimac Industries, Inc., West Caldwell, N.J.

[21] Appl. No.: 236,657

[22] Filed: Aug. 25, 1988

[51] Int. Cl.[5] ..... H01P 5/20

[52] U.S. Cl. ..... 333/121; 333/116; 333/161

[58] Field of Search ..... 333/109, 112–116, 333/121, 122, 24.1, 161

[56] References Cited

U.S. PATENT DOCUMENTS

| | | | |
|---|---|---|---|
| 2,849,685 | 8/1958 | Weiss | 333/113 X |
| 2,850,626 | 9/1958 | Tomiyasu . | |
| 3,573,651 | 4/1971 | Engelbrecht | 333/109 X |
| 3,737,810 | 6/1973 | Shelton . | |
| 3,748,601 | 7/1973 | Seidel . | |
| 3,980,972 | 9/1976 | Podell et al. . | |
| 3,996,533 | 12/1976 | Lee . | |
| 4,011,528 | 3/1977 | Podell et al. . | |
| 4,254,385 | 3/1981 | Childs et al. | 333/104 |
| 4,389,594 | 6/1983 | Conciauro et al. | 333/109 X |
| 4,723,307 | 2/1988 | Clark et al. | 333/109 X |

*Primary Examiner*—Bernarr E. Gregory
*Attorney, Agent, or Firm*—Lerner, David, Littenberg, Krumholz & Mentlik

[57] ABSTRACT

A broad band microwave stripline magic tee designed for a center microwave frequency is disclosed. The magic tee includes a pair of 3db quadrature couplers connected in tandem to one another through a 90° differential phase shift circuit. Each of the 3db quadrature couplers includes a first port, a second port, a third port and a fourth port. The 90° differential phase shift circuit includes first and second conductors therein having apparent electrical lengths that differ from one another by 270° at the microwave center frequency. The second port of the first coupler is serially connected through the first conductor of the phase shift circuit to the first port of the second coupler, and the third port of the first coupler is serially connected through the second conductor of the phase shift circuit to the fourth port of the second coupler. The first and fourth ports of the first coupler, and the second and third ports of the second coupler, serve as respective pairs of input and output ports of the magic tee, so that the application of a microwave input signal to one of the input ports results in output signals at the output ports that are of substantially equally amplitude and substantially in phase with one another, and the application of a microwave input signal to the other of the input ports results in output signals at the output ports that are of substantially equal amplitude and substantially 180° out of phase with one another. The magic tee has left-to-right symmetry so that the roles of the input and output ports can be reversed.

10 Claims, 3 Drawing Sheets

MICROWAVE STRIPLINE CIRCUITRY

BACKGROUND OF THE INVENTION

This invention relates to microwave stripline circuitry and, more particularly, to microwave stripline circuits that are used in forming magic tees.

Conventional microwave stripline magic tees, for example the so-called rat-race or 1.5 wave length circumference ring, are four-port, 3db coupling devices employed in converting a microwave input signal of a given power level into two either in-phase or 180° out of phase output microwave signals, each of which output signals is at one-half the power level of the input signal. The rat-race devices have four arms that are connected to corresponding ports or terminals and are separated by 60° of angular rotation from one another. Thus, for a common input arm, there are two output arms spaced one-quarter wave length away and a fourth terminated arm spaced one-quarter wave length away from one of the output arms and three-quarters wave length away from the other output arm. At center frequency, the power split from the common input arms to the two output arms is equal; however, the phase relationship between the two outputs is 0°. Similarly, if power is fed in at the fourth arm, the power split to the two previously mentioned output arms is also equal; however, the phase relationship between the two outputs is 180°.

Although conventional stripline magic tees are satisfactory 3db coupling devices for splitting microwave input signals into in-phase or 180° out of phase output signals of equal amplitude, at a design center frequency and over a narrow adjacent frequency band, they have not been effective for use as broad band (for example octave-wide) 3db couplers due to the fact that significant phase variations occur in the output signals as the input frequency departs from the design center frequency of the device.

It is, therefore, a primary object of the present invention to provide an improved microwave stripline magic tee.

Another object of this invention is to provide a microwave stripline magic tee capable of operating over a greater band width, for a given amount of output signal phase variation, than has heretofore been the case.

A still further object of the invention is to provide a microwave stripline magic tee capable of operating with a lesser amount of output signal phase variation, over a given narrow frequency band, than has heretofore been the case.

Additional objects and advantages of this invention will become apparent as the following description proceeds.

SUMMARY OF THE INVENTION

Briefly stated, and in accordance with one embodiment of this invention, there is provided a broad band stripline magic tee designed to operate about a microwave center frequency. The magic tee includes a pair of 3db quadrature couplers connected in tandem to one another through a 90° differential phase shift circuit. Each of the 3db quadrature couplers includes a first port, a second port, a third port and a fourth port. The 90° differential phase shift circuit includes first and second conductors therein having apparent electrical lengths that differ from one another by 270° at the center microwave frequency. The second port of the first coupler is serially connected through the first conductor of the phase shift circuit to the first port of the second coupler, and the third port of the first coupler is serially connected through the second conductor of the phase shift circuit to the fourth port of the second coupler. The first and fourth ports of the first coupler, and the second and third ports of the second coupler, serve as respective pairs of input and output ports of the magic tee, so that the application of a microwave input signal to one of the input ports results in output signals at the output ports that are of substantially equally amplitude and substantially in phase with one another, and the application of a microwave input signal to the other of the input ports results in output signals at the output ports that are of substantially equal amplitude and substantially 180° out of phase with one another.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION

Figure 1:
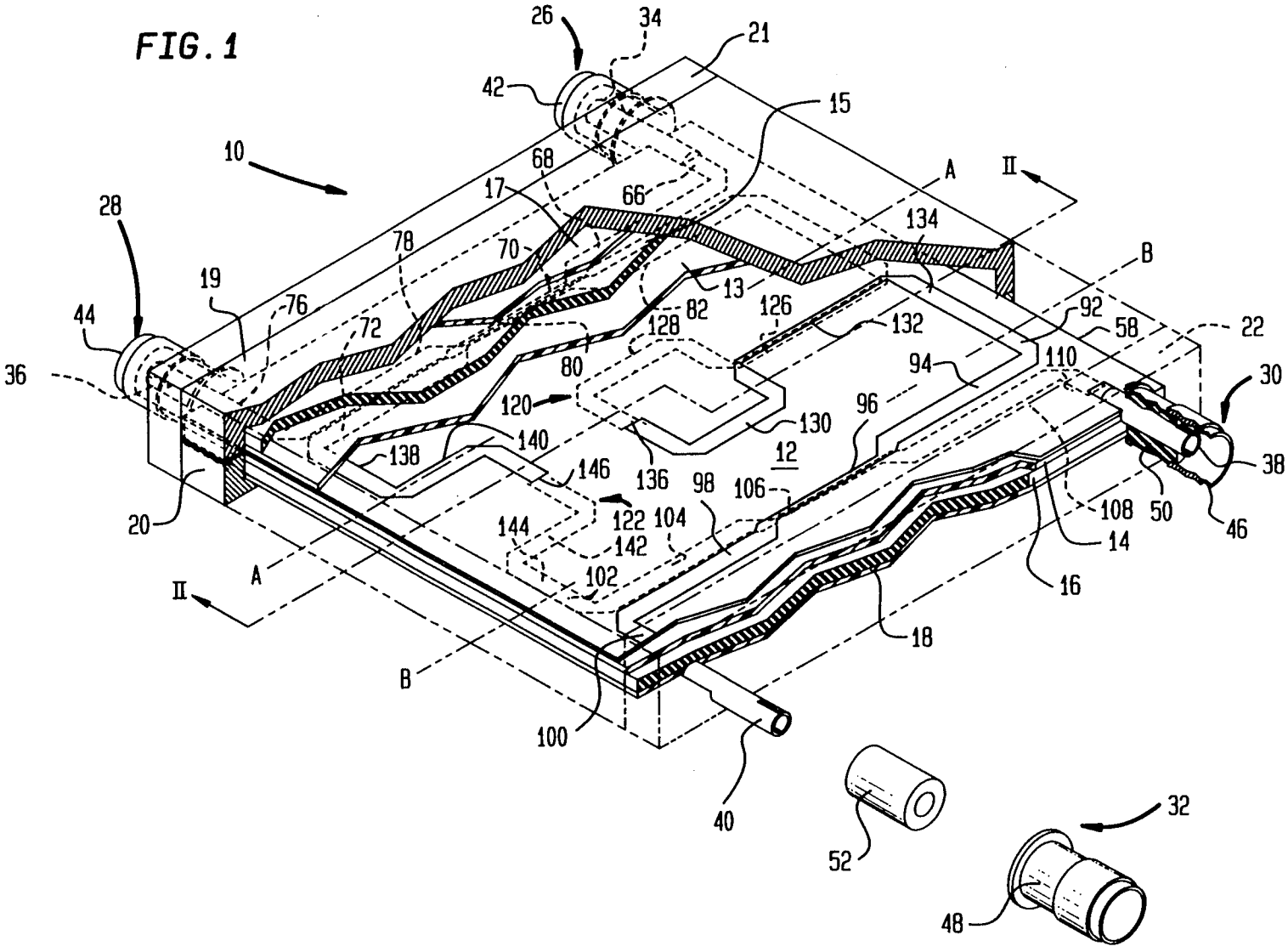
FIG. 1 is perspective view, with parts broken away for clarity, of a microwave stripline magic tee in accordance with one embodiment of this invention.
Figure 2:
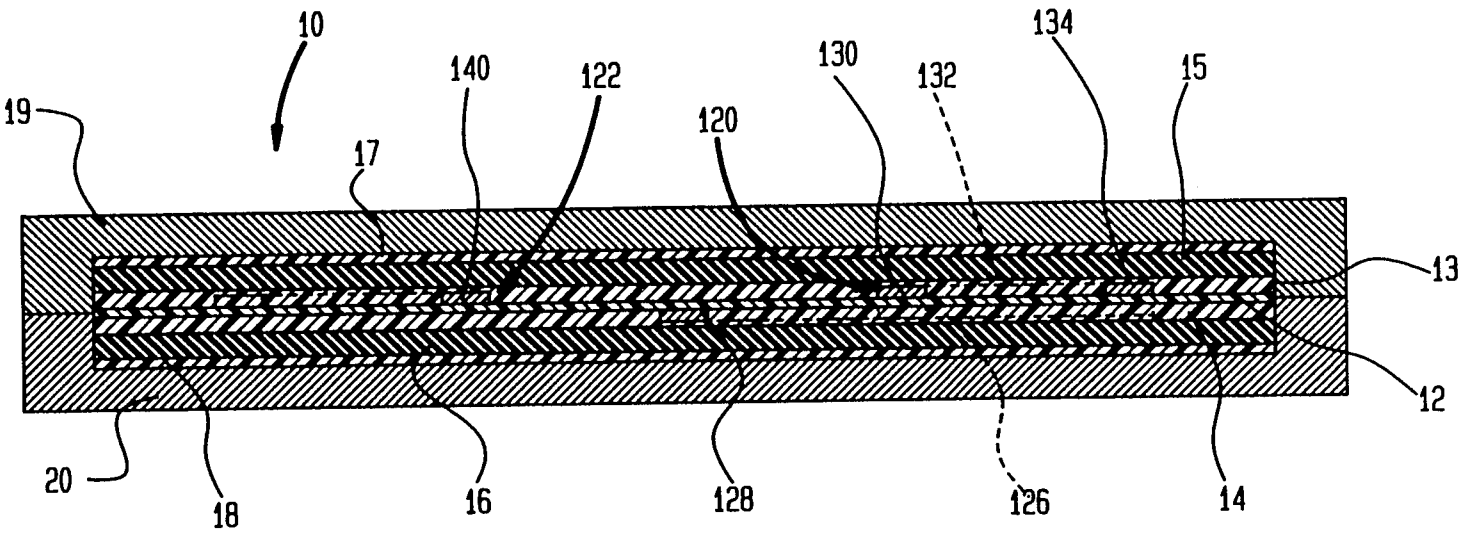
FIG. 2 is a sectional elevation view, taken along the line II—II of FIG. 1.
Figure 3:
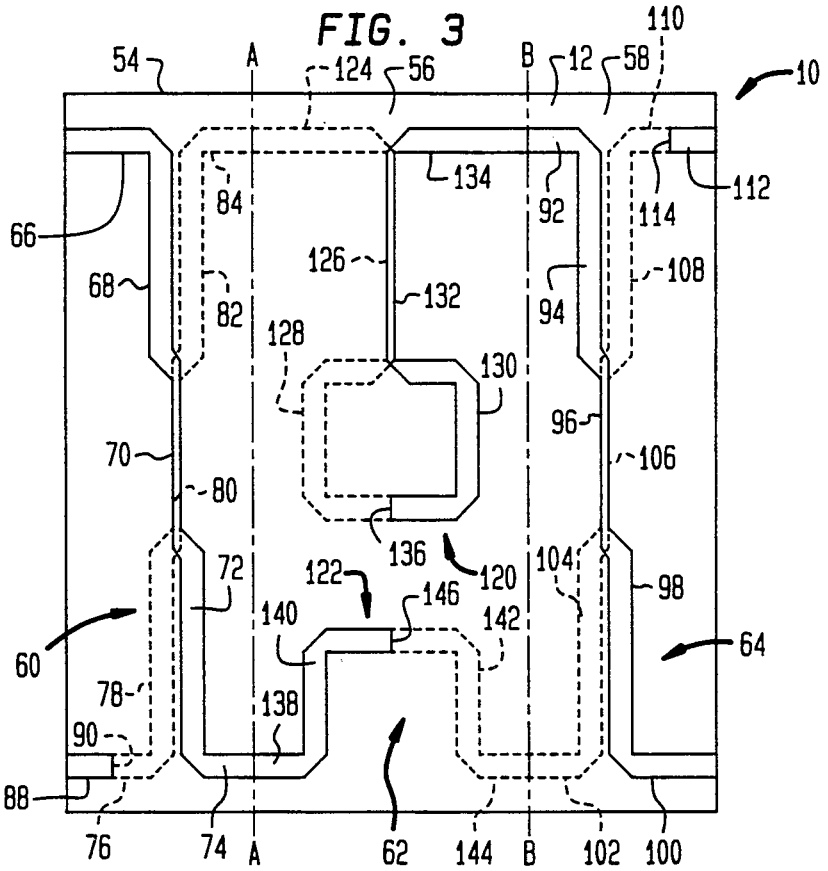
FIG. 3 is a plan view of an etched, printed circuit board of the magic tee of FIG. 1.

Referring to FIGS. 1–3, a microwave stripline magic tee in accordance with one embodiment of this invention has been illustrated generally at 10. The magic tee 10 includes a printed circuit board 12 the printed circuit of which is preferably etched from a low loss, copper clad, Teflon-fiberglass material. The board 12 is sandwiched between a first set of upper and lower laminating films or bonding layers 13 and 14, respectively, which are preferably made from an acrylic material. The laminating films 13 and 14, in turn, are sandwiched between respective upper and lower insulating cover boards 15 and 16 which are preferably made from Teflon-fiberglass materials. A second set of upper and lower laminating films or bonding layers 17 and 18, respectively, join the upper and lower cover boards 15 and 16 to respective upper and lower U-shaped metallic casing members 19 and 20 that are of aluminum or other suitable metal capable of forming ground planes for the stripline circuitry. The metal casing members 19 and 20 are securely fastened to one another, as by through bolts or the like (not shown), and are electrically grounded to one another.

The magic tee 10 is provided with a pair of input connectors, shown generally at 26 and 28, and pair of output connectors, shown generally at 30 and 32, which serve as input and output ports for the magic tee, respectively. Each of the connectors 26, 28, 30 and 32 includes a corresponding center terminal 34, 36, 38 and 40, which terminals are soldered to corresponding input and output terminal portions of the printed circuit board 12, as will be described in greater detail hereinafter.

The connectors 26, 28, 30 and 32 are also provided with corresponding outer connector shells 42, 44, 46 and 48. The outer connector shells 42–48 are preferably made from gold plated beryllium copper to afford an optimum combination of high strength and wear characteristics consistent with low loss requirements. The outer connector shells 42–48 are preferably attached to metallic end caps 21 and 22, which caps, in turn, are attached to the first and second ground-plane-forming metallic casing members 19 and 20 to complete the ground connections therebetween. Also, Teflon cylindrical insulators, two of which are shown at 50 and 52, are provided within the connectors 26–32 to insulate the center terminals 34–40 of the connectors from the grounded outer connector shells 42–48 thereof and to provide the proper impedance for the connectors.

As shown more clearly in FIGS. 2 and 3, the printed circuit board 12 is provided with etched, stripline conductors on the upper and lower surfaces thereof, which interconnect with one another at selected places through apertures in the board 12, as will appear more clearly hereinafter. For convenience, the printed circuit board 12 may be considered to be divided into three zones, a first zone 54, a second zone 56 and a third zone 58, by the dot and dash reference lines A—A and B—B shown in FIG. 3.

The zones 54, 56 and 58 of circuit board 12 are provided with respective circuit portions thereon comprising a first four-port, 3db quadrature coupler, shown generally at 60, a 90° differential phase shifter, shown generally at 62, and a second four-port, 3db quadrature coupler, shown generally at 64. The 3db quadrature couplers 60 and 64 are connected in tandem to one another through the 90° differential phase shifter 62, as will appear more clearly hereinafter.

The four-port, 3db quadrature coupler 60 includes a first stripline conductor formed on the upper surface of the board 12 that comprises an input port section 66, a first coupling section 68, a second coupling section 70, a third coupling section 72 and an output port section 74. The first coupler 60 also includes a second stripline conductor formed on the undersurface of board 12 that comprises an input port section 76, a first coupling section 78, a second coupling section 80, a third coupling section 82 and an output port section 84. Coupling sections 68 and 82 are loosely coupled to one another, as are coupling sections 72 and 78. Coupling sections 70 and 80, on the other hand, are tightly coupled to one another. Accordingly, coupler 60 comprises a conventional three section, four-port, 3db quadrature coupler, the conventional ports (usually numbered 1, 2, 3 and 4) of which comprise the respective ports 66, 84, 74 and 76.

To facilitate interconnecting the center terminal 36 (FIG. 1) of connector 28 to the input port section, or fourth port, 76 of coupler 60, a portion 88 of stripline conductor is formed on the upper surface of board 12 above the input port section 76 and is electrically connected thereto, as by soldering, through an aperture 90 formed in board 12.

The second four-port, 3db quadrature coupler 64, located in the third zone 58 of board 12, is essentially a duplicate of the first four-port, 3db quadrature coupler 60. Thus, coupler 64 also includes a stripline conductor formed on the upper surface of the board 12 that comprises an input port section 92, a first coupling section 94, a second coupling section 96, a third coupling section 98 and an output port section 100. The second coupler 64 also includes a second stripline conductor formed on the undersurface of board 12 that comprises an input port section 102, a first coupling section 104, a second coupling section 106, a third coupling section 108 and an output port section 110. As in the case of the first coupler 60, coupling sections 94 and 108 are loosely coupled to one another, as are coupling sections 98 and 104. Coupling sections 96 and 106, on the other hand, are tightly coupled to one another, so that coupler 64 also comprises a conventional three section, four-port, 3db quadrature coupler, the conventional ports (usually numbered 1, 2, 3 and 4) of which comprise the respective ports 92, 110, 100 and 102.

As in the case of the first coupler 60, a portion 112 of stripline conductor is formed on the upper surface of board 12 above the output port section 110 and is electrically connected thereto, as by soldering, through an aperture 114 formed in board 12, to facilitate interconnecting the center terminal 38 (FIG. 1) of connector 30 to the output port section, or second port, 110 of coupler 64.

The 90° differential phase shifter 62, located in the second zone 56 of the printed circuit board 12, will now be considered in greater detail. The 90° differential phase shifter 62 includes a first stripline conductor, shown generally at 120, which serially interconnects the output port section 84 of the first coupler 60 with the input port section 92 of the second coupler 64. Differential phase shifter 62 also includes a second stripline conductor, shown generally at 122, which serially interconnects the output port section 74 of first coupler 60 with the input port section 102 of the second coupler 64. Conductors 120 and 122 each include portions thereof that are formed on the upper surface of circuit board 12 which interconnect with portions thereof formed on the undersurface of board 12. Thus, first conductor 120 includes an input section 124, a first coupling section 126 and an uncoupled section 128 formed on the undersurface of board 12. First conductor 120 also includes a second uncoupled section 130, a second coupling section 132 and an output section 134 formed on the upper surface of the board 12. The two uncoupled sections 128 and 130 are soldered to one another through an aperture 136 formed in the board 12.

The second stripline conductor 122 of differential phase shifter 62 also includes sections thereof that are formed on the upper and undersurfaces of circuit board 12. Thus, second conductor 122 includes an input section 138 and a first uncoupled section 140 formed on the upper surface of board 12, and a second uncoupled section 142 and an output section 144 formed on the undersurface of board 12. The two uncoupled sections 140 and 142 are soldered to one another through an aperture 146 formed in the board 12.

The electrical lengths of the various sections of conductors 120 and 122 are so selected relative to the design center frequency of the magic tee that the electrical length of the first conductor 120 at such frequency is 270° longer than the electrical length of the second conductor 122 at that frequency. Accordingly, when separate signals are applied to the input sections 124 and 138 of the differential phase shifter 62, the phase of the output signal at output section 134 of the phase shifter is shifted negatively by 90° relative to the phase of the output signal appearing at the output section 144. This 90° phase shifting occurs throughout the octave wide band surrounding the design center frequency of the magic tee. A differential phase shifter of the type discussed herein is described in my earlier U.S. Pat. No. 3,761,843, dated Sept. 25, 1973, which is assigned to the assignee of the present invention. The disclosure of such patent is incorporated by reference herein.

Figure 4:
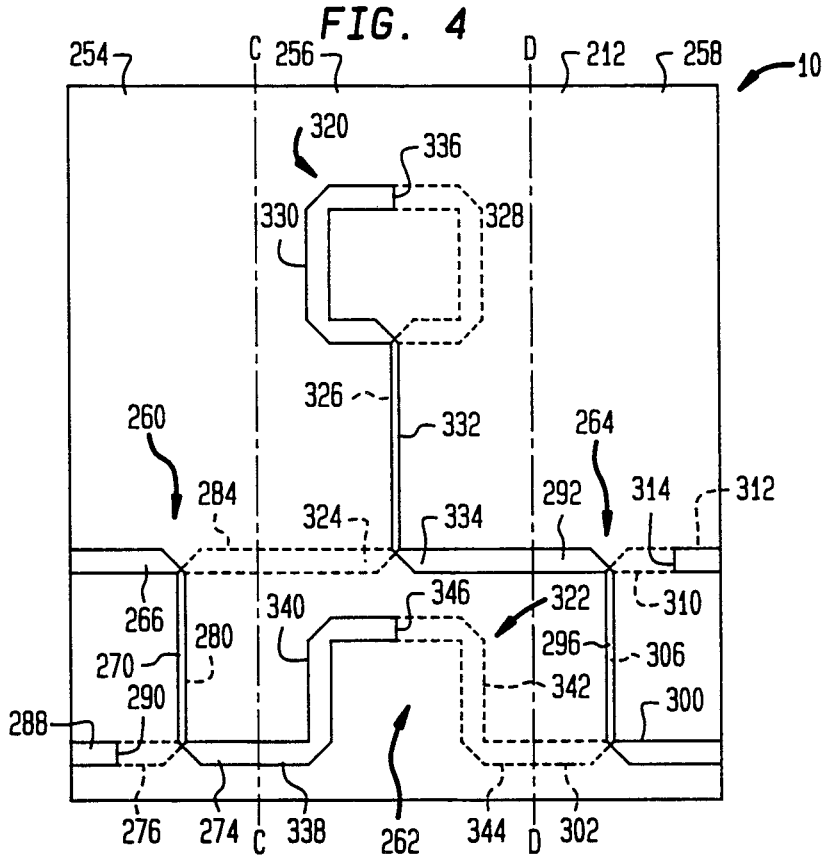
FIG. 4 is a plan view of an etched, printed circuit board used in a magic tee in accordance with an alternate embodiment of this invention.

Referring to FIG. 4, an etched printed circuit board 212 for a magic tee in accordance with an alternate embodiment of this invention is disclosed. For convenience, parts in this alternate embodiment corresponding to parts shown in the FIGS. 1–3, or first, embodiment will be identified by numerals that are 200 numbers higher than the corresponding numbers shown in FIGS. 1–3. As in the first embodiment, the printed circuit board 212 is provided with etched, stripline conductors on the upper and lower surfaces thereof, which interconnect with one another at selected places through apertures in the board 212. Also, the printed circuit board is divided into three zones, a first zone 254, a second zone 256 and a third zone 258, by the dot and dash reference lines C—C and D—D.

The zones 254, 256 and 258 of circuit board 212 are provided with respective circuit portions thereon comprising a first, single-section, four-port, 3db quadrature coupler, shown generally at 260, a 90° differential phase shifter, shown generally at 262, and a second, single-section, 3db quadrature coupler, shown generally at 264. The 3db quadrature couplers 260 and 264 are connected in tandem to one another through the 90° differential phase shifter 262.

The four-port, 3db quadrature coupler 260 includes a first stripline conductor formed on the upper surface of the board 212 that comprises an input port section 266, a coupling section 270 and an output port section 274. The first coupler 260 also includes a second stripline conductor formed on the undersurface of board 212 that comprises an input port section 276, a coupling section 280 and an output port section 284. Coupling sections 270 and 280 are tightly coupled to one another. Accordingly, coupler 260 comprises a conventional single-section, four port, 3db quadrature coupler, the conventional ports (usually numbered 1, 2, 3 and 4) of which comprise the respective ports 266, 284, 274 and 276.

As in the first embodiment, to facilitate interconnecting the center terminal 36 (FIG. 1) of connector 28 to the input port section, or fourth port, 276 of coupler 260, a portion 288 of stripline conductor is formed on the upper surface of board 212 above the input port section 276 and is electrically connected thereto, as by soldering, through an aperture 290 formed in board 12.

The second, single-section, four-port, 3db quadrature coupler 264, located in the third zone 258 of board 212, is essentially a duplicate of the first, single-section, four-port, 3db quadrature coupler 260. Thus, coupler 264 also includes a stripline conductor formed on the upper surface of the board 212 that comprises an input port section 292, a coupling section 296 and an output port section 300. The second coupler 264 also includes a second stripline conductor formed on the undersurface of board 212 that comprises an input port section 302, a coupling section 306 and an output port section 310. Coupling sections 296 and 306 are tightly coupled to one another, so that coupler 264 also comprises a conventional single-section, four-port, 3db quadrature coupler, the conventional ports (usually numbered 1, 2, 3 and 4) of which comprise the respective ports 292, 310, 300 and 302.

As before, a portion 312 of stripline conductor is formed on the upper surface of board 212 above the output board section 310 and is electrically connected thereto, as by soldering, through an aperture 314 formed in board 212, to facilitate interconnecting the center terminal 38 (FIG. 1) of connector 30 to the output port section, or second port, 310 of coupler 264.

The 90° differential phase shifter 262, located in the second zone 256 of the printed circuit board 212, will now be considered in greater detail. The 90° differential phase shifter 262 is essentially similar to the 90° phase shifter 62 of FIG. 3 except that the first stripline conductor thereof, shown generally at 320, is inverted from the position it occupies in the FIG. 3 embodiment in order to provide clearance between the first stripline conductor 320 and the second stripline conductor 322. The first stripline conductor 320 serially interconnects the output port section 284 of first coupler 260 with the input port section 292 of second coupler 264. The second stripline conductor 322 serially interconnects the output port section 274 of first coupler 260 with the input port section 302 of second coupler 264. As before, conductors 320 and 322 each include portions thereof that are formed on the upper surface of circuit board 212 which interconnect with portions thereof formed on the undersurface of board 212. Thus, first conductor 320 includes an input section 324, a first coupling section 326 and an uncoupled section 328 formed on the undersurface 212. First conductor 320 also includes a second uncoupled section 330, a second coupling section 332 and an output section 334 formed on the upper surface of the board 212. The two uncoupled sections 328 and 330 are soldered to one another through an aperture 336 formed in the board 212.

The second stripline conductor 322 of phase shifter 262 also includes sections thereof that are formed on the upper and lower surfaces of circuit board 212. Thus, second conductor 322 includes an input section 338 and a first uncoupled section 340 formed on the upper surface of board 212, and a second uncoupled section 342 and an output section 344 formed on the undersurface of board 212. The two uncoupled sections 340 and 342 are soldered to one another through an aperture 346 formed in the board 212.

As in the case of the embodiment of FIG. 1–3, the electrical lengths of the various sections of conductors 320 and 322 are so selected relative to the design center frequency of the FIG. 4 embodiment of the magic tee that the electrical length of the first conductor 320 at such frequency is 270° longer than the electrical length of the second conductor 322 at that frequency. Accordingly, when separate signals are applied to the input sections 324 and 338 of the differential phase shifter 262, the phase of the output signal at output section 334 of the phase shifter is shifted negatively by 90° relative to the phase of the output signal appearing at the output section 344. Here again, the 90° phase shifting occurs throughout the octave wide band surrounding the design center frequency of the magic tee.

Although two embodiments of this invention have been shown, one of which (FIGS. 1–3) involves a pair of three-section, four-port, 3db quadrature couplers separated by a 90° differential phase shifter and the other of which (FIG. 4) involves a pair of single-section, four-port, 3db quadrature couplers separated by a 90° differential phase shifter, it is apparent that other 3db quadrature couplers than those illustrated may be employed without departing from this invention in its broader aspects. Thus, it does not matter whether the coupler has one section, three sections, or more sections, so long as the coupler is symmetric about its two center lines and, in the case of a commensurate system of lines, includes an odd number of sections.

Considering the circuitry shown in FIG. 3 at this time, the flow of signals through the magic tee 10 will now be considered in greater detail. Assuming that input port section 76 (port 4) of the magic tee is properly terminated and that a microwave signal at the design center frequency is applied to input port section 66 (port 1) of the magic tee, each of the output port sections 84 and 74 of the first coupler 60 will have signals thereon the amplitudes of which are 3db reduced from the amplitude of the input signal. Also, under such conditions, the phase of the signal at output port section 74 will lag 90° behind the phase of the output signal at output port section 84. The signals on output ports 84 and 74 are introduced into the 90° differential phase shifter 62 via the input sections 124 and 138, respectively, thereof. These signals pass through the differential phase shifter and appear at the output sections 134 and 144, respectively, with their amplitudes essentially unchanged and in phase with one another (i.e., the phase of the signal going through first conductor 120 has been shifted negatively by 90° relative to the phase of the signal going through conductor 122). The in-phase signals at output sections 134 and 144 then proceed through the input port sections 92 and 102, respectively, of the second 3db quadrature coupler 64, and arrive at the respective output port sections 110 and 100 (ports 2 and 3 of the magic tee) substantially in phase with one another and of substantially equal amplitude relative to one another.

Similarly, if the input port section 66 (port 1 of the magic tee) is properly terminated and an input signal at the design center frequency is applied to input port section 76 (port 4 of the magic tee), the resulting signals at the output port sections 84 and 74 are each also reduced in amplitude by 3db from the input signal and, in this case, the phase of the signal on output port section 84 lags the phase of the signal on output port section 74 by 90°. These signals are then fed through the 90° differential phase shifter 62 via input sections 124 and 138, respectively, to output sections 134 and 144, respectively, at which output sections the amplitudes of the signals are essentially equal to one another and the phase of the signal on output section 134 lags the phase of the signal on output section 144 by 180°. These signals are then fed through respective input port sections 92 and 102 of the second 3db coupler 64 and they then appear at the output port sections 110 and 100, respectively with their amplitudes substantially equal and with the signal at output port section 110 substantially 180° out of phase with the signal at output port section 100.

From the foregoing description, it will be seen that the necessary conditions for a magic tee are provided by this invention. With a signal applied to port 1 of the magic tee (input port section 66), the outputs of ports 2 and 3 (output sections 110 and 100, respectively) are equal in magnitude and in phase. Conversely, when an input is provided to port 4 (input port section 76), the outputs at ports 2 and 3 (output port sections 110 and 100, respectively) of the magic tee are equal in magnitude and 180° out of phase with one another. Also, the magic tee 10 has left-to-right symmetry in that when an input signal is applied to port 2 (port section 110), output signals that are of equal magnitude and in phase with one another will appear at ports 1 and 4 (port sections 66 and 76, respectively), and when an input signal is applied to port 3 (port section 100), output signals that are of equal magnitude and 180° out of phase with one another will appear at ports 1 and 4 (port sections 66 and 76, respectively).

It should be noted that a single section 3db coupler (for an octave band) has an even-mode impedance of 2.5425. A differential phase shifter for an octave band (90° +/− 1.5°) has an even-mode impedance of 3.08. Because of the difference in impedance between the coupler and the phase shifter, the 3-section coupler of FIGS. 1–3 is the preferred coupler to use as the coupling element. In this case the differential phase shifter has the same impedance as the center section of the coupler making it easier to manufacture. It should also be noted that the magic tee 10 of this invention, involving a pair of 3db quadrature couplers separated by a 90° differential phase shifter, is significantly self-compensating, reducing the amplitude imbalance and keeping the phase imbalance to a minimum. This provides a magic tee that is capable of operating over a greater band width for a given amount of output signal phase variation than is the case with conventional magic tees, and provides a magic tee capable of operating with a lesser amount of output signal phase variation, when operated within a given narrow frequency band, than is the case with conventional magic tees.

While particular embodiments of this invention have been shown and described, it will be obvious to those skilled in the art that various other changes and modifications may be made without departing from this invention in its broader aspects. For example, stripline magic tees in accordance with this invention can be made with multi-section couplers other than those referred to earlier herein, and can be built with multi-section differential phase shifters. In each case the couplers should be as close to equal split as possible, because the amplitude deviation converts to phase deviation, and the phase differential should be as close to 90° a possible to minimize phase error. It is, therefore, aimed in the appended claims to cover all such changes and modifications as fall within the true spirit and scope of this invention.

What is claimed is:

1. A broad band stripline magic tee designed for a center microwave frequency, comprising first and second 3db quadrature couplers each having a first port, a second port, a third port, and a fourth port; and a non-reflective, non-adjustable 90° differential phase shift circuit interconnecting said first and second couplers, said phase shift circuit including first and second conductors therein having apparent electrical lengths at said center microwave frequency that differ from one another by 270°, said second port of said first coupler being serially connected through said first conductor to said first port of said second coupler, said third port of said first coupler being serially connected through said second conductor to said fourth port of said second coupler, said first and fourth ports of said first coupler and said second and third ports of said second coupler serving as respective pairs of input and output ports of said magic tee, whereby the application of a microwave input signal within said band to one of said input ports results in output signals at said output ports that are of substantially equal amplitude and substantially in phase with one another, and the application of said microwave input signal to the other of said input ports results in signals at said output ports that are of substantially equal amplitude and substantially 180° out of phase with one another, said magic tee having left-to-right symmetry and being reversible in operation.

2. A stripline magic tee according to claim 1, wherein each of said couplers includes a first line interconnecting its first and third ports and a second line interconnecting its second and fourth ports, wherein each line of each of said couplers comprises an odd number of coupling sections, and wherein said coupling sections of each of said couplers are symmetric about the centerlines of said couplers.

3. A stripline magic tee according to claim 2, wherein each of said couplers includes one coupling section.

4. A stripline magic tee according to claim 2, wherein each of said couplers includes three coupling sections.

5. A broad band stripline magic tee designed for a center microwave frequency, comprising first and second 3db quadrature couplers each having a first port, a second port, a third port, and a fourth port; and a 90° differential phase shift circuit interconnecting said first and second couplers, said phase shift circuit including first and second conductors therein having apparent electrical lengths at said center microwave frequency that differ from one another by 270°, said second port of said first coupler being serially connected through said first conductor to said first port of said second coupler, said third port of said first coupler being serially connected through said second conductor to said fourth port of said second coupler, said first and fourth ports of said first coupler and said second and third ports of said second coupler serving as respective pairs of input and output ports of said magic tee, said first conductor of said differential phase shifter including at least two coupled 90° lengths and an uncoupled 180° length therein, and said second conductor of said differential phase shifter including at least one uncoupled 90° length therein, whereby the application of a microwave input signal within said band to one of said input ports results in output signals at said outport ports that are of substantially equal amplitude and substantially in phase with one another, and the application of said microwave input signal to the other of said input ports results in signals at said output ports that are of substantially equal amplitude and substantially 180° out of phase with one another.

6. A stripline magic tee according to claim 5, wherein each of said couplers includes a first line interconnecting its first and third ports and a second line interconnecting its second and fourth ports, wherein each line of each of said couplers comprises an odd number of coupling sections, and wherein said coupling sections of each of said couplers are symmetric about the centerlines of said couplers.

7. A stripline magic tee according to claim 6, wherein each of said couplers includes one coupling section.

8. A stripline magic tee according to claim 6, wherein each of said couplers includes three coupling sections.

9. A stripline magic tee according to any one of claims 5–8, wherein said uncoupled 180° length of said first conductor is connected in series between said two coupled 90° lengths thereof.

10. A stripline magic tee according to claim 9, wherein each of said first and second conductors of said differential phase shifter includes first and second additional uncoupled lengths therein that are equal to the corresponding first and second additional uncoupled lengths in the other of said conductors so that the total electrical length of one of said conductors differs from the total electrical length of the other of said conductors by 270° at said center microwave frequency.

* * * * *